US006367281B1

(12) United States Patent
Hugenroth

(10) Patent No.: US 6,367,281 B1
(45) Date of Patent: Apr. 9, 2002

(54) SOLID PHASE CHANGE REFRIGERATION

(76) Inventor: Jason James Hugenroth, 707 Town Dr., Hope, AR (US) 71801

( * ) Notice: Subject to any disclaimer, the term of this patent is extended or adjusted under 35 U.S.C. 154(b) by 0 days.

(21) Appl. No.: 09/866,206

(22) Filed: May 24, 2001

Related U.S. Application Data

(60) Provisional application No. 60/206,956, filed on May 25, 2000.

(51) Int. Cl.[7] ..... F25B 23/00
(52) U.S. Cl. ..... 62/467
(58) Field of Search ..... 62/467

(56) References Cited

U.S. PATENT DOCUMENTS 2,931,189 A * 4/1960 Sigworth ..... 415/141
3,036,444 A * 5/1962 Cochran ..... 62/467
5,339,653 A * 8/1994 DeGregoria ..... 165/10

* cited by examiner

*Primary Examiner*—William E. Tapolcai

(57) ABSTRACT

A refrigeration cycle is disclosed whereby: straining a material results in a solid phase change of the material. This phase change is accompanied by an adiabatic and nearly reversible temperature rise in the material. The material in its strained state rejects heat to its surroundings. When said material is relaxed from its strained state, a solid phase change occurs back to its initial phase. This phase change is accompanied by an adiabatic and nearly reversible temperature drop, in the material. In the relaxed state said material absorbs heat from a low temperature source.

22 Claims, 2 Drawing Sheets

SOLID PHASE CHANGE REFRIGERATION

CROSS-REFERENCE TO RELATED APPLICATIONS

Provisional application No. 60/206,956, filing date of May 25, 2000.

BACKGROUND OF THE INVENTION

Disclosed herein is an invention for the operation of a refrigeration cycle using the strain induced phase change in the crystallographic structure of a material. Of particular interest are certain types of alloys known as shape memory alloys. Like most solids, these materials exhibit a thermoelastic effect. The thermoelastic effect refers to a phenomenon whereby; when a solid is heated or cooled a volume change occurs. Conversely, if a solid's volume is changed (e.g. by straining it) a temperature change occurs. The thermoelastic effect is well known in the art.

Shape memory alloys, which are known in the art, are able to undergo large plastic strains and then recover this strain when they are heated above a characteristic transformation temperature ($A_f$). This occurs due to a change in phase of the alloy's grain structure. Above $A_f$ the material exists predominately or exclusively in the parent phase (P). Below the temperature $M_s$, where $M_s<A_f$, the grain structure is predominately in the martensite phase (M). When the material is in the M-phase it is ductile and deforms easily.

When a shape memory alloy is heated above $A_f$ it reverts to the parent phase (P) of the material. If the material was deformed plastically when it was in the M-phase heating to above $A_f$ results in the material recovering its pre-strained shape. This is true for even rather large plastic deformations. In addition the forces driving the phase change and hence the shape change are very strong, in fact stronger than the yield strength of the material. Another property associated with most shape memory alloys is that, if a stress is applied to the material when the temperature of the material is above $A_f$ the resulting strain results in the growth of the M-phase crystals, just as if the material were at a temperature below $M_s$. When the stress is removed the strain is recovered and the material reverts to the P-phase. This behavior results in a very springy material that can undergo large recoverable strains as compared to conventional metals. This behavior is termed superelasticity or psuedoelasticity. The temperature $A_f$ can be controlled to great precision within a fairly large temperature range when the proper alloying and heat treatments are performed. For example $A_f$ can be set at or below room temperature so that the superelastic effect is present at room temperature or below.

The background information above is known in the art. The invention disclosed herein uses the strain induced phase change such as that which occurs in superelastic materials to produce a refrigeration effect. As described below, when operated in a cyclical manner, a refrigeration cycle is produced.

A refrigeration cycle absorbs heat from a low temperature source and rejects it to a high temperature sink. Work input or energy input is required to operate the refrigeration cycle. The refrigeration cycle can also be used to provide efficient heating. This is accomplished by utilizing the heat rejected at the high temperature sink. When operated in this fashion the device is usually termed a heat pump. It should be noted that if the refrigeration cycle is being used for heating or cooling it is the same cycle.

To achieve the refrigeration effect the invention makes use of the fact that the strain induced M-phase in the material also results in an adiabatic and largely reversible temperature increase, of said material. When the strain is removed an adiabatic and largely reversible temperature drop occurs, in said material. In other words the temperature increase observed when the material is strained is, at least in part, not caused by irreversible phenomenon such as friction. By selectively straining the material and rejecting heat to a high temperature sink, and relaxing the material and absorbing heat from a low temperature source, a refrigeration cycle is achieved. The disclosed refrigeration cycle has advantages over other known refrigeration cycles. One advantage is that it is extremely simple and robust. Another advantage is that it does not use chemicals that can deplete the ozone layer or contribute to global warming.

The use of the thermoelastic effect to achieve a refrigeration cycle is known in the art. In particular, it is well documented in the art that elastomers exhibit a thermoelastic effect. For example U.S. Pat. No. 3,036,444 discloses the use of elastomeric blades to achieve a refrigeration effect. What is inventive is using the strain induced phase change of a material, to produce a refrigeration effect. Whereas, in an elastomer, the strain induced temperature change is achieved through partial alignment of the threadlike molecular strands that make up the material, not via a phase change of the material. The present invention has several advantages over elastomer based thermoelastic refrigeration cycles. One such advantage is that unlike elastomers, shape memory alloys have very good fatigue properties. Therefore, a refrigeration device employing shape memory alloys would have substantially greater service life than one using elastomers. Another advantage is that many shape memory alloys, being metallic in nature, are good thermal conductors. This allows for more efficient rejection and absorption of heat, by the heat sink or source respectively.

SUMMARY OF THE INVENTION

In a disclosed embodiment of the invention, a coil spring made out of superelastic wire is looped around two pulleys, of unequal diameter. Each pulley is driven at the same rotation rate via drive means. Since the pulleys rotate at the same speed; as the coil spring leaves the small diameter pulley and is pulled onto the large diameter pulley, the spring will stretch. This will increase the temperature of the spring. The spring is now hotter than the ambient air so heat will be lost to the surrounding air and the spring will cool to approximately the same temperature as the surrounding air. A fan or other means of forced air cooling may be used to increase heat transfer. As the wire leaves the large pulley and is pulled onto the small pulley the spring will contract. At the same time the wire enters the refrigerated space. When the spring contracts its temperature decreases to a temperature below that of the refrigerated space. The spring then absorbs heat from the refrigerated space, lowering the temperature of the refrigerated space.

The disclosed embodiment may be modified to use a mesh of superelastic wire or superelastic material in sheet form. In this embodiment drum rollers replace the pulleys. The larger surface area of the mesh or sheet results in increased cooling or heating capacity.

In another embodiment superelastic wire is rolled, in a spiral fashion, along a drum roller. This strain increases the temperature of the wire. Air is forced over the wire while it is on the drum, to enhance the rejection of heat to the surroundings. When the wire unrolls from the pulley the strain is released, and the temperature of the wire drops. At the same time the wire enters the refrigerated space, where it absorbs heat from the refrigerated space.

In yet another embodiment rectangular pieces of superelastic fins are attached to a continuous belt, that is held between two pulleys. The fins face toward the outside of the loop formed by the belt. The fins are attached generally perpendicular to the belt. For a portion of the path traced by the belt the fins come in contact with a guide piece that deforms the fins straining the superelaatic material. The strain increases the temperature of the fins. Cooling air is used to increase heat rejection to the surroundings. When the fins move out of contact with the guide piece they straighten. The removal of strain decreases the temperature of the fins. At the same time the fins enter the refrigerated space where they absorb heat from their surrounds (i.e. the refrigerated space).

DETAILED DESCRIPTION OF THE INVENTION

Figure 1:
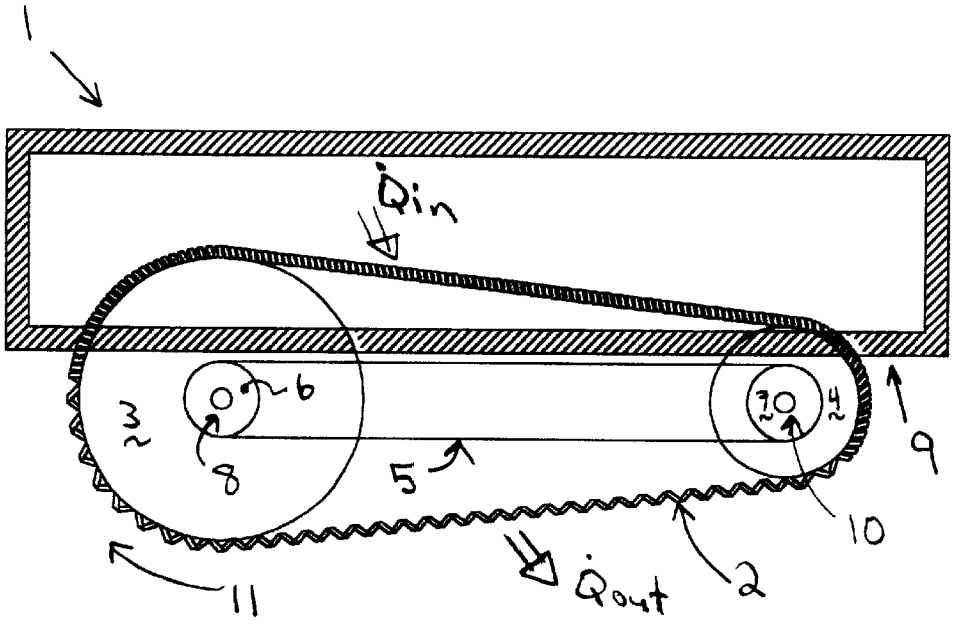
FIG. 1 is a first embodiment of the invention.

A refrigeration system 1 in FIG. 1 is shown having a master pulley 3, and a slave pulley 4. A coil spring 2 made of superelastic wire loops around the pulleys as shown. A drive belt 5 loops around a first drive pulley 6 and a second drive pulley 7 which are concentric and axially displaced from the master pulley 3 and the slave pulley 4 respectively. Master pulley 3 and the first drive pulley 6 are on a common shaft 8 and bearing, not shown, and are driven by a drive means, not shown. Slave pulley 4 and the second drive pulley 7 reside on a common shaft 10 and bearing, not shown. No appreciable slippage or stretching of the drive belt 5 occurs; therefore the rotational speeds of all of the pulleys are the same. The pulleys rotate in a clockwise direction as indicated by arrow 11. For the same rotation angle spring 2 travels further over the master pulley 3 than it does over the slave pulley 4. This results in the lower portion of spring 2, as shown in FIG. 1, being stretched as it is pulled toward the master pulley 3. The said stretching results in a nearly adiabatic reversible temperature increase of the spring 2. The temperature, of said stretched portion of the spring 2, is now higher than the temperature of the surrounding air; therefore heat from the stretched portion of spring 2 is transferred to the surroundings ($Q_{out}$). The stretched portion of spring 2 is cooled until its temperature is at or near the ambient air temperature. When the stretched portion of spring 2 travels around to the other side of the master pulley 3 this portion of spring 2 now contracts. This results in an adiabatic temperature decrease of the upper portion of spring 2, as shown in FIG. 1. Since the upper portion of spring 2 was at or near room temperature before contracting, it is now below room temperature. At the same time the upper portion of spring 2 is contracting it enters the refrigerated space 9 where it absorbs heat ($Q_{in}$) from its surroundings. As can been seen in FIG. 1, the lower portion of the spring 2 is continuously being stretched, while the upper portion of the spring 2 is continuously contracting. In this way a continuous and efficient refrigeration cycle is produced. It can also be appreciated from FIG. 1 that the lower portion of the spring 2 puts a torque on the master pulley 3 that opposes the rotational direction of the master pulley 3, while the upper portion of the spring 2 puts a torque on the master pulley 3 in the same rotational direction as the master pulley 3. In this way, a portion of the work required to stretch the spring is recovered, thus reducing the total work input required and increasing the overall cycle efficiency.

Figure 2:
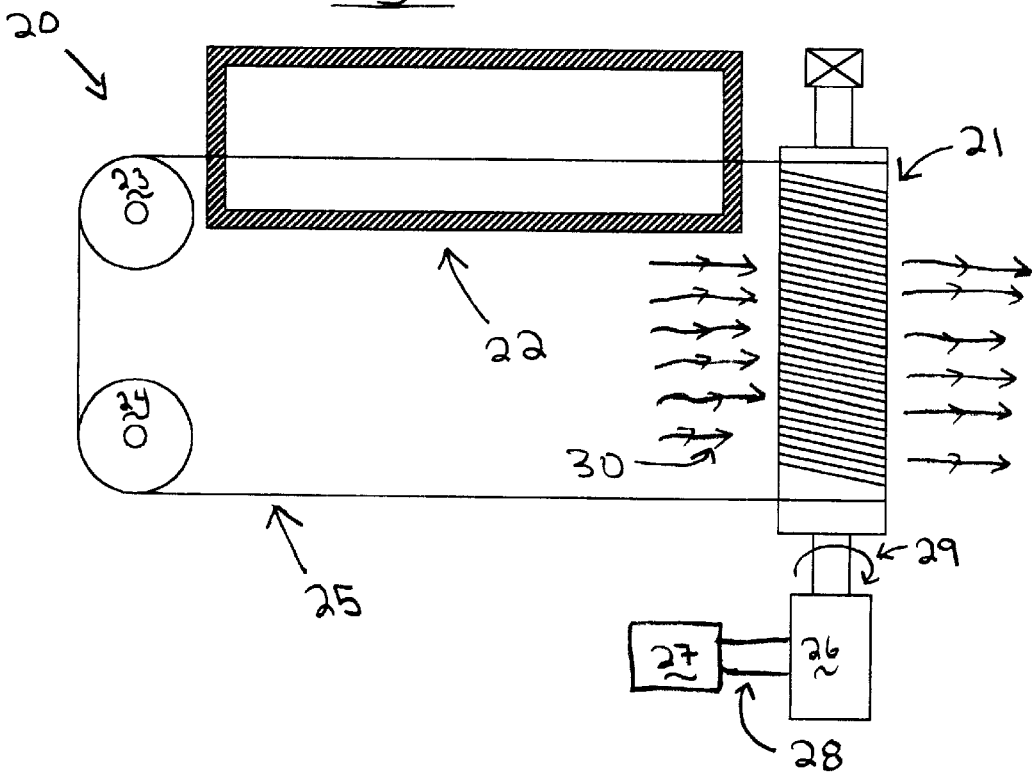
FIG. 2 is a second embodiment of the invention.

A refrigeration system 20 shown in FIG. 2 consists of in essence: a drum roller 21, a refrigerated space 22, a first idler pulley 23, a second idler pulley 24, and a superelastic wire 25. The drum roller is rotated by an electric motor 26, which is powered by a power supply 27. Power leads 28 carry power from the power supply 27 to the motor 26. The drum rotates in the direction shown by the arrow 29. As the drum rotates the superelastic wire is wrapped around the drum. This strains the wire, increasing its temperature. Forced air shown by arrows 30 cools the wire to at or near the ambient temperature. Guides, not shown, on the drum 21 guide the wire upward along the drum 21 as the motor 26 rotates the drum 21. When the wire 25 reaches the top of the drum 21 it unrolls and enters the refrigerated space 22. When the wire 25 unrolls the strain is removed and the temperature of the wire 25 drops. The wire 25 absorbs heat from the refrigerated space at this time. When the wire 25 leaves the other end of the refrigerated space it is guided by first idler pulley 23 and second idler pulley 24 into proper position for wrapping around the drum 21 again. The cycle then repeats itself.

Figure 3:
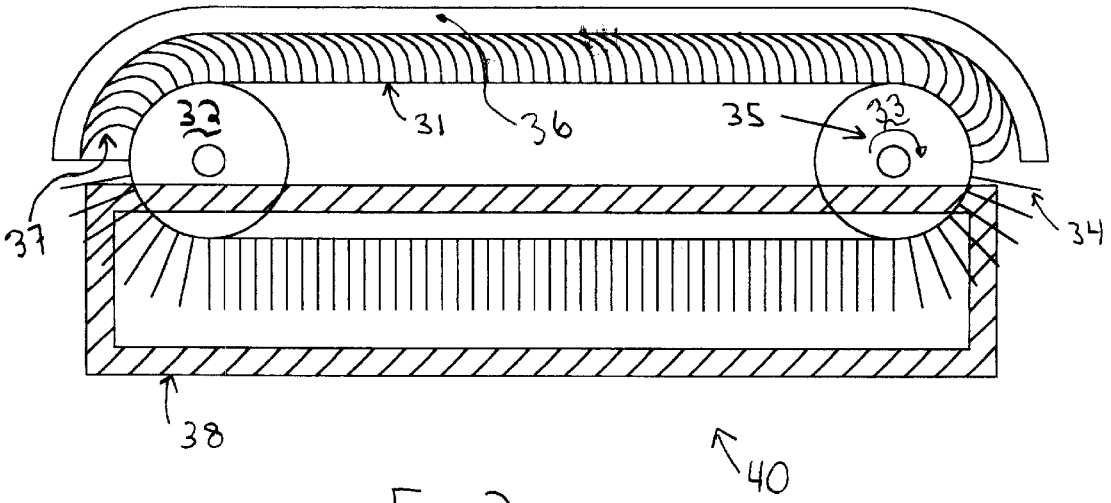
FIG. 3 is a third embodiment of the invention.
Figure 4:
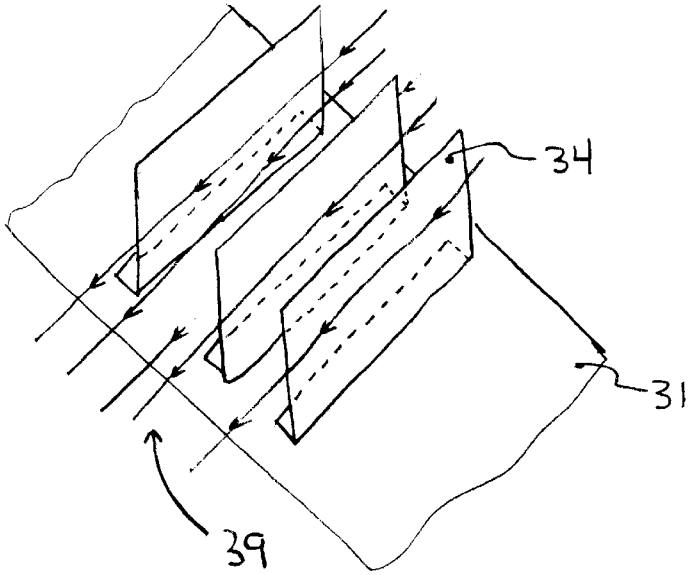
FIG. 4 is a detailed view of the third embodiment of the invention.

A refrigeration system 40 shown in FIG. 3 consists of a belt that is suspended between a drive pulley 33 and a driven pulley 32. The drive pulley 33 is driven clockwise as shown by arrow 35 by a drive means not shown. The rotation of the drive pulley 33 pulls the belt along while the driven pulley 32 maintains tension in the belt 31. Attached to the belt 31 are several superelastic rectangular fins 34. Above the belt 31 as shown in FIG. 3 is a fin guide 36. The fin guide 36 is rigid compared to the flexible fins 34. When the fins 34 contact the fin guide 36 they are deformed as shown. The deformation strains the fins 34 causing their temperature to increase. Forced air flow, perpendicular to the page, not shown, helps transfer heat from the strained fins 37 to the surrounding air which is initially at a lower temperature than the strained fins 37. To the right in FIG. 3 the strained fins 37 come out of contact with the fin guide 36. At the same time the fins enter the refrigerated space 38. When the fins 34 are no longer in contact with the fin guide they resume their unstrained shape. This is accompanied by a temperature drop, to a temperature below that of the refrigerated space. Forced air 39 moves parallel to the orientation of the fins 34. This improves heat transfer.

Preferred embodiments of the invention have been disclosed. It should be recognized that, a worker in the art would recognize that certain modifications come within the scope of the invention. For that reason the following claims should be studied to determine the true scope and content of this invention.

I claim:

1. A refrigeration system comprising: a material of a first phase, that when strained undergoes a phase change to a second phase, said phase change resulting in an adiabatic and at least partially reversible temperature increase of said material; said material going from second said phase to first said phase when relaxed from a strained state, said relaxation resulting in an adiabatic and at least partially reversible temperature drop of said material; a means for selectively straining and relaxing said material, said strained material rejecting heat to a high temperature sink, said relaxed material absorbing heat from a low temperature source.

2. A refrigeration system as recited in claim 1, where a portion of the energy required to strain said material is recovered when said material is relaxed from a strained state, thus reducing the total energy input required to operate said refrigeration system.

3. A refrigeration system as recited in claim 1, where said material is arranged in a configuration such that a first portion of said material is in a said strained state, while a second portion of said material is in a said relaxed state.

4. A refrigeration system as recited in claim 1, where a plurality of said material pieces are disposed, such that one or more said material pieces is in a said strained state, while one or more said material pieces is in a said relaxed state.

5. A refrigeration system as recited in claim 1, where said first phase is austenite, and said second phase is martensite.

6. A refrigeration system as recited in claim 1, where said material is a shape memory alloy.

7. A refrigeration system as recited in claim 1, where said material is a superelastic alloy.

8. A refrigeration system as recited in claim 1, where said material is a Nickel Titanium alloy.

9. A refrigeration system as recited in claim 1, where said material is in wire form.

10. A refrigeration system as recited in claim 1, where said material is in sheet form.

11. A refrigeration system as recited in claim 1, where said material is a mesh formed of wires, sheets or ribbons.

12. A refrigeration system comprising:

a material of a first crystalline phase structure, that when strained undergoes a change in phase to a second crystalline phase structure, and when relaxed, from a stained state, returns to said first crystalline phase structure;

said material undergoing an adiabatic and at least partially reversible temperature rise when strained, said material undergoing an adiabatic and at least partially reversible temperature drop when relaxed from a strained state;

said material rejecting heat to a high temperature sink, when strained, and said material absorbing heat from a low temperature source, when said material is relaxed from a strained state;

a means for selectively straining and relaxing said material, such that when strained the said material is in thermal contact with a high temperature sink, and when relaxed said material is in thermal contact with a low temperature source.

13. A refrigeration system as recited in claim 9, where a portion of the energy required to strain said material is recovered when said material is relaxed from a strained state, thus reducing the total energy input required to operate said refrigeration system.

14. A refrigeration system as recited in claim 9, where said material is arranged in a configuration such that a first portion of said material is in a said strained state, while a second portion of said material is in a said relaxed state.

15. A refrigeration system as recited in claim 9, where a plurality of said material pieces are disposed, such that one or more said material pieces is in a said strained state, while one or more said material pieces is in a said relaxed state.

16. A refrigeration system as recited in claim 9, where said first crystalline phase is Austenite, and said second crystalline phase is Martensite.

17. A refrigeration system as recited in claim 9, where said material is a shape memory alloy.

18. A refrigeration system as recited in claim 9, where said material is a superelastic alloy.

19. A refrigeration system as recited in claim 9, where said material is a Nickel Titanium alloy.

20. A refrigeration system as recited in claim 9, where said material is in wire form.

21. A refrigeration system as recited in claim 9, where said material is in sheet form.

22. A refrigeration system as recited in claim 9, where said material is a mesh formed of wires, sheets or ribbons.

* * * * *